United States Patent [19]

Reames, Jr.

[11] 4,175,518

[45] Nov. 27, 1979

[54] PREHEATER DEVICE FOR HOT WATER HEATERS

[76] Inventor: Cedric (Ted) A. Reames, Jr., R.R. #2, Adel, Iowa 50003

[21] Appl. No.: 879,063

[22] Filed: Feb. 21, 1978

[51] Int. Cl.[2] ..... F22B 1/18; F22D 1/00

[52] U.S. Cl. ..... 122/20 B; 122/412; 122/421

[58] Field of Search ..... 122/20 B, 412, 421

[56] References Cited

U.S. PATENT DOCUMENTS

| | | | |
|---|---|---|---|
| 1,113,003 | 10/1914 | Griffin | 122/20 |
| 2,521,462 | 9/1950 | Kinzelmann | 122/20 |
| 3,916,991 | 11/1975 | Trump | 122/20 |
| 3,987,761 | 10/1976 | Downs et al. | 122/20 |
| 4,037,567 | 7/1977 | Torres | 122/20 |
| 4,043,014 | 8/1977 | Wilson | 122/20 |

*Primary Examiner*—Kenneth W. Sprague
*Attorney, Agent, or Firm*—Zarley, McKee, Thomte, Voorhees & Sease

[57] ABSTRACT

A preheating device for hot water heaters which employs hot gases of combustion from the flue to preheat incoming cold water and to continually preheat water stored in the water tank by natural recirculation. Use of the device provides for increased fuel efficiency because hot combustion gases from the heat source are used for warming of water before venting to the atmosphere, the result being an average increased temperature within the tank so that lesser amounts of fuel are required to reach any desired hot water temperature.

9 Claims, 2 Drawing Figures

PREHEATER DEVICE FOR HOT WATER HEATERS

BACKGROUND OF THE INVENTION

The present invention relates to a water heating system which employs a preheater. Preheaters for hot water heating systems are not per se new. It has been suggested many times in the past that hot flue gases may be used in order to preheat incoming water for a hot water tank. This invention relates to an improvement upon this basic system.

The improvement of this invention provides for preheating of all incoming cold water and for simultaneously recirculating portions of water stored within the storage tank in order to increase the average temperature of the stored water. The result is an increased fuel efficiency over the prior art preheater systems.

Accordingly, one object of this invention is to provide a water heating system which utilizes hot flue gases to preheat not only incoming cold water, but also for recirculating and preheating water from the storage tank of the system. Another object of this invention is to provide a water heating system which is of increased fuel efficiency.

Yet another object of this invention is to provide a system which will by natural convections, continually recirculate water from the water storage tank through the preheater during periods of time when water is not being drawn off from the hot water heater.

Another object of this invention is to provide an improved preheating device which emloys baffles to provide air turbulence and increased heat exchange efficiency between hot flue gases and water circulating through the hot flue gases inside of a copper tubing.

Other objects and advantages of this invention will become readily apparent from the following description of the invention.

DETAILED DESCRIPTION OF THE INVENTION

Figures 1, 2:
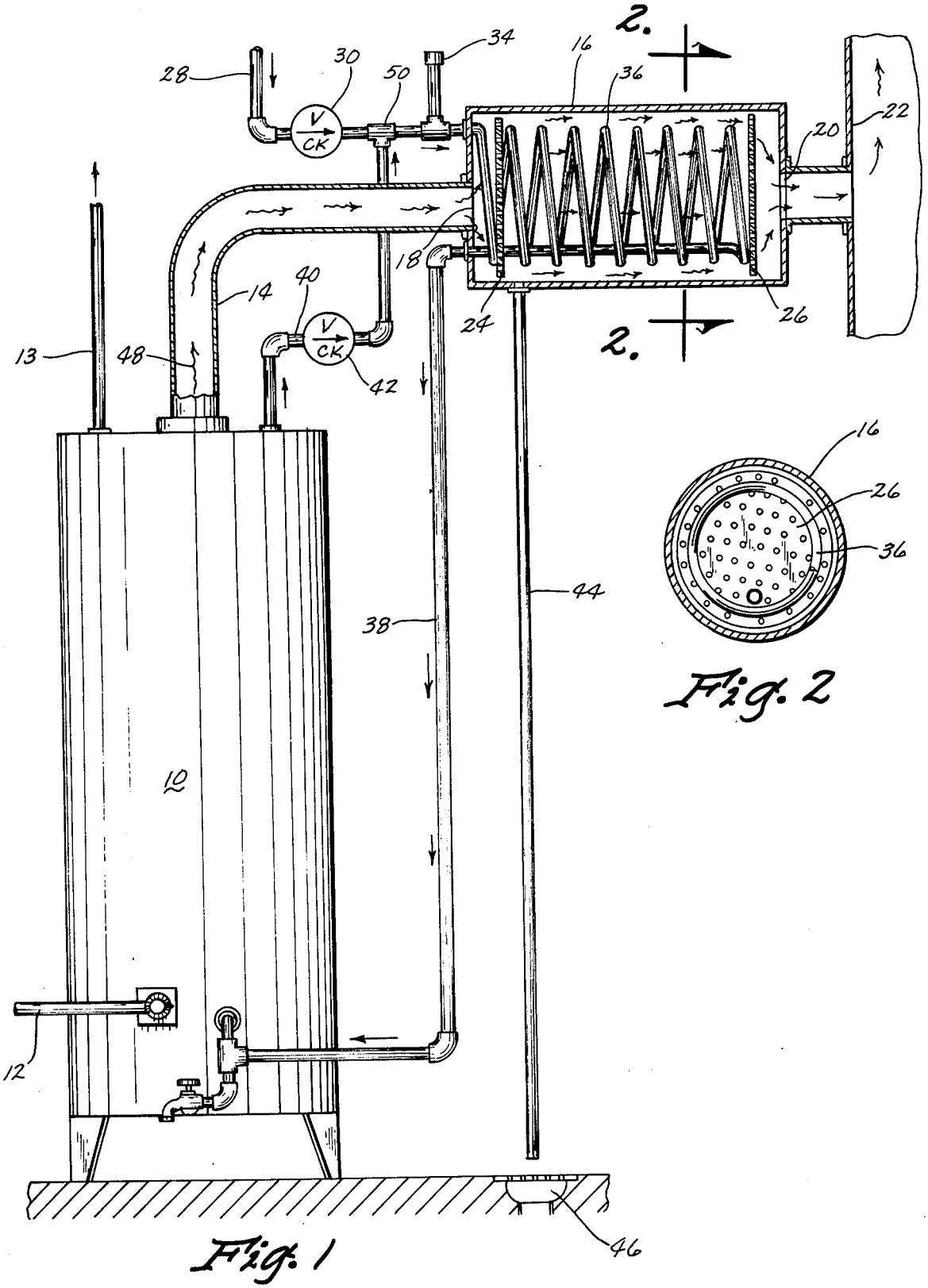
FIG. 1 is a schematic drawing, with certain parts broken away showing a water heating system embodying the invention.
FIG. 2 is a sectional view through the manifold of FIG. 1.

Water heater 10 is of conventional construction and does not per se form a part of the invention, and accordingly it will not be described in detail. It has a conventional gas supply line 12 leading to a burner, not specifically depicted, to provide a heat source for hot water within tank 10. Hot water tank 10 has a hot water outlet line 13 and an exhaust flue 14 for removal of hot flue gases resulting from the combustion of heating gas. Manifold chamber 16 is positioned on the exhaust flue line and has a gas inlet aperture 18 and a gas outlet aperture 20. Outlet aperture 20 leads to chimney 22.

Mounted within manifold 16 is a forward baffle 24 and a rearward baffle 26. Baffles 24 and 26 are of light construction and are positioned inside manifold 16 in order to provide increased air turbulence. Cold water inlet line 28 has a check valve 30 positioned on said line and an air bleed off nipple 34 also positioned thereon. Cold water inlet line 28 extends inside of manifold 16 wherein it is in communication with a coil line 36. Coil line 36 is preferably made of copper in order to have maximum heat exchange efficiency. Coil line 36 after passing through manifold 16 is in communication with storage tank 10 via water inlet line 38.

At the top of storage tank 10 and in communication with storage tank 10 and cold water inlet line 28 is a preheat water recirculation line 40. Check valve 42 is positioned on preheat water circulation line 40, for reasons which will be discussed later. Drain pipe 44 extends from manifold 16 downwardly in order to allow condensed water to drain out and pass down to floor drain 46.

In actual operation, the water system of this invention works in the following manner. The description will be presented in steady state operation, assuming the hot water tank 10 is full. With hot water tank 10 full and the water hot from a gas burner fed by gas supply 12 hot water as it is needed on demand is removed from the tank via hot water exit line 13. Hot flue gas enters the exhaust flue 14 as depicted by arrows 48 and passes into the interior of the manifold 16 and through forward baffle 24 wherein it circulates around copper coil line 36. Cold water is fed into the system via cold water inlet 28, passes through check valve 30 and into coil line 36. The hot flue gas as depicted by arrows 48 surrounds coil line 36 and provides heat exchange to warm the water within coil line 36. The warmed, how preheated water, passes out of coil line 36 into cold water inlet 38 and from there into the bottom of tank 10. When water is not being drawn off via hot water outlet 13, the natural tendency will be for the preheated water entering tank 10 through line 28 to rise by convection currents. Portions of the rising hot water exit from the top of tank 10 into recirculation line 40, through check valve 42, through T-joint 50 and thence into coil line 36, wherein the recirculation is repeated. Recirculating water is of course warmed as it passes through coil line 36, just as is cold water which newly enters the system via line 28.

During periods of time when there is no hot water being drawn off, this recirculation will continue, keeping the water warmed and taking advantage of the heat energy present in the hot flue gases, which continually pass through manifold 16, out of manifold exit aperture 20 and ultimately escape through a vent 22 to the outside. Drain line 44 is provided for manifold 16 in order to allow condensation from the interior of manifold 16 to be taken to drain 46. Air bleed off valve 34 is present so that its cap may be removed and air bled out of the system as needed. Check valve 30 on cold inlet line 28 prevents the recirculating water from entering into the cold inlet line and check valve 42 is to prevent circulating water from draining back down into the top of tank 10 without going through the recirculation line. Baffles 24 and 26 provide turbulences to air inside of manifold 16 in order to provide increased heat exchange capability between hot flue gases 48 and coil line 36.

It therefore can be seen that all new cold water which enters into the system is preheated in accordance with this invention prior to entering tank 10. In addition, some portion of the hot water in tank 10 is continually recirculated through manifold 16 in order to provide a continual warming. In this manner the most efficient use is made of the fuel in that the system maximizes the use of the available heat energy.

It therefore can be seen that the invention accomplishes all of its stated objectives.

What is claimed is:

1. A preheater for water heaters and the like comprising:

a cold water line in connection with a source of cold water;

a water container having upper and lower ends, an inlet line connected adjacent said lower end and a hot water outlet line, a source of heat, and a flue to carry away the products of combustion from said heat source;

a manifold imposed in said flue above said upper end of said container, a coil line imposed within said manifold and having a second end in connection with said inlet line of said container, and a first end in communication with said cold water line, whereby cold water will pass through said coil line prior to entering said container adjacent said lower end thereof;

a recirculating line connected adjacent said upper end of said container and in connection with said cold water line upstream of said coil;

a first check valve means in said recirculation line above said container to permit flow of water from said recirculating line only in a direction away from said container, and a second check valve means in said cold water line upstream from said manifold and said recirculating line to permit cold water to flow only towards said manifold and to prevent water from said recirculating line from entering said cold water line.

2. The heating system of claim 1 wherein said coil line is a copper coil line.

3. The heating system of claim 1 wherein said manifold has positioned within its interior, at least one baffle in order to provide air tubulence.

4. The system of claim 1 wherein said manifold has means to remove condensation therefrom.

5. A preheater for water heaters and the like according to claim 1 wherein said manifold has opposite ends, a gas inlet aperture being formed in one of said ends and being in communication with said flue for receiving hot gases therefrom, a gas outlet aperture being formed in the other of said ends for permitting gases to escape from said manifold; at least one baffle means within said manifold between said opposite ends thereof for imparting turbulence to said gases as they pass from said outlet to said outlet apertures, thereby enhancing exchange of heat from said gases to said coil line.

6. A preheater for water heaters according to claim 5 wherein a condensation drain line is in communication with the interior of said manifold and extends downwardly therefrom for draining condensation therefrom.

7. A preheater according to claim 5 wherein said baffle means is in covering and inward spaced relation to said gas inlet aperture whereby at least a portion of said gases entering said manifold from said inlet apreture are diverted around the margins of said baffle means as they pass from said inlet aperture to said outlet aperture.

8. A preheater according to claim 7 wherein a second baffle means is positioned in covering and inward spaced relation to said gas outlet aperture whereby at least a portion of said gases are diverted around the outer margins of said second baffle means prior to exiting from said outlet aperture.

9. A preheater according to claim 8 wherein said first mentioned baffle means and said second baffle means include a plurality of baffle apertures therein for permitting a portion of said gases to pass therethrough.

* * * * *